United States Patent [19]

Takahashi et al.

[11] Patent Number: 4,938,807

[45] Date of Patent: Jul. 3, 1990

[54] PROCESS FOR PRODUCTION OF GRAIN ORIENTED ELECTRICAL STEEL SHEET HAVING HIGH FLUX DENSITY

[75] Inventors: Nobuyuki Takahashi; Yozo Suga; Katsuro Kuroki, all of Kyushu, Japan

[73] Assignee: Nippon Steel Corporation, Tokyo, Japan

[21] Appl. No.: 301,637

[22] Filed: Jan. 25, 1989

[30] Foreign Application Priority Data

Feb. 3, 1988 [JP] Japan ..... 63-21864

[51] Int. Cl.[5] ..... H01F 1/047

[52] U.S. Cl. ..... 148/111; 148/113

[58] Field of Search ..... 148/111, 113

[56] References Cited

U.S. PATENT DOCUMENTS 3,159,511 12/1964 Taguchi et al. ..... 148/111
4,171,994 10/1979 Miller Jr. ..... 148/111

FOREIGN PATENT DOCUMENTS 30-03651 5/1955 Japan .
33-04710 6/1958 Japan .
40-15644 7/1965 Japan .
48-51852 7/1973 Japan .
51-20716 2/1976 Japan .
51-13461 4/1976 Japan .
51-13469 4/1976 Japan .
53-19913 2/1978 Japan .
57-45818 9/1982 Japan .
59-56522 2/1984 Japan .
62-40315 2/1987 Japan .

OTHER PUBLICATIONS

Transactions of the Metallurgical Society of Aime 212 (1958) pp. 769–781, by J. E. May and D. Turnbull.
Transactions of the Metallurgical Society of Aime 212 (1961) pp. 1201–1205, by H. C. Fiedler.
Iron and Steel, 53 (1967) pp. 1007–1023, by T. Matsuoka.
Japan Institute of Metals, 27 (1963) pp. 186–191, by T. Saito.

*Primary Examiner*—Melvin J. Andrews
*Attorney, Agent, or Firm*—Kenyon & Kenyon

[57] ABSTRACT

Disclosed is a process for the preparation of a grain oriented silicon steel about sheet having a high flux density, which comprises hot-rolling a slab comprising 1.5 to 4.8% by weight of Si, 0.012 to 0.050% by weight of Al, 0.0010 to 0.0120% by weight of N, 0.0020 to 0.0150% by weight of Ti, up to 0.45% by weight of Mn and up to 0.012% by weight of at least one member selected S and Se, which satisfies the requirement 0.06 to 0.6 of Ti/N (at % ratio) and Mn/(S+Se)≧4.0 (weight ratio) with the balance comprising Fe and unavoidable impurities, to cold-rolling, performing decarburization annealing, coating an annealing separator on the steel sheet surface, then performing finish annealing, and performing a nitriding treatment of the steel sheet during the period of from the point of termination of final cold rolling to the point of initiation of secondary recrystallization at the finish annealing step.

6 Claims, 3 Drawing Sheets

PROCESS FOR PRODUCTION OF GRAIN ORIENTED ELECTRICAL STEEL SHEET HAVING HIGH FLUX DENSITY

BACKGROUND OF THE INVENTION

1. Field of the Invention

The present invention relates to a process for the production of a grain oriented electrical steel sheet used as an iron core of an electric device. More particularly, the present invention relates to a process in which the slab-heating temperature is lower than 1200° C., i.e., a production process in which an inhibitor is formed after the completion of cold rolling, where a product having a high flux density can be prepared even from a material having a high Si content.

2. Description of the Prior Art

A grain oriented electrical steel sheet is composed of crystal grains having a Goss orientation having a <001> axis in the rolling direction on the {110} plane [expressed as orientation {110}<001> by Miller indices], and is used as a soft magnetic material for an iron core of a transformer or electric appliance.

This steel sheet should have excellent magnetic characteristics, such as magnetization and iron loss characteristics, but whether or not the magnetization characteristics are good depends on the density of the magnetic flux induced in an iron core under the magnetic field applied, and if a product having a high flux density (grain oriented electrical steel sheet) is used, the size of the iron core can be diminished.

A steel sheet having a high flux density can be obtained by an optimum arrangement of the orientation of crystal grains in {110}<001>.

The term, iron loss, refers to the loss of power consumed as heat energy when an alternating magnetic field is applied to the iron core, and whether or not the iron loss characteristic is good depends on the flux density, the sheet thickness, the impurity content in the steel, the resistivity, the crystal grain size, and the like.

A steel sheet having a high flux density is preferred because the size of the iron core of an electric appliance can be diminished and the iron loss can be reduced, and therefore, development of a process for preparing a product having as high a flux density as possible, at a low cost, is urgently required in the art.

A grain oriented electrical steel sheet is prepared by the secondary recrystallization process, in which a hot-rolled sheet obtained by hot-rolling a slab is subjected to an appropriate combination of cold rolling and annealing to form a steel sheet having a final thickness, and the steel sheet subjected to finish annealing to selectively grow primary recrystallized grains having an orientation {110}<001>, i.e., secondary recrystallization.

The presence of fine precipitates, for example, MnS, AlN, MnSe, (Al, Si)N, and $Cu_2S$, and intergranular elements such as Sn and Sb in the steel sheet before secondary recrystallization is indispensable for the attainment of a secondary recrystallization. As explained by J. E. May and D. Turnbull [Trans. Met. Soc. AIME 212 (1958), pages 769–781], these precipitates and intergranular elements exert a function of selectively growing grains having an orientation {110}<001> while controlling the growth of primary recrystallized grains in an azimuth other than the orientation {110}<001> at the finish annealing step.

This effect of controlling the growth of grains is generally called the inhibitor effect.

Accordingly, a serious problem in the research in the art is how to clarify what precipitate or intergranular element should be used for stabilizing a secondary recrystallization, or how an appropriate presence state of the precipitate or intergranular element should be attained for increasing the presence ratio of grains having a precise orientation {110}<001>.

Since a high degree of control of the orientation {110}<001> is limited by the use of one kind of precipitate, development of a technique for preparing a product having a high flux density, stably and at a low cost, is now under serious study, and the merits and demerits of various precipitates and an organical combination of several precipitates are being examined.

Regarding the kind of precipitates, MnS is reported by N. F. Littmann in Japanese Examined Patent Publication No. 30-3651 and J. E. May and D. Turnbull in Trans Met Soc. AIME 221 (1958), pages 769–781, AlN and MnS are reported by Taguchi and Sakakura in Japanese Examined Patent Publication No. 33-4710, VN is reported by Fiedler in Trans. Met. Soc. AIME 212 (1961), pages 1201–1205, MnSe and Sb are reported by Imanaka et al in Japanese Examined Patent Publication No. 51-13469, AlN and copper sulfide are reported by J. A. Salsgiver et al in Japanese Examined Patent Publication No. 57-45818, and (Al, Si)N is reported by Komatsu et al in Japanese Examined Patent Publication No. 62-45285. Furthermore, TiS, CrS, CrC, NbC and $SiO_2$ are known.

As the intergranular element, As, Sn and Sb are reported by Tatsuo Saito in Journal of the Japan Institute of Metals, 27 (1963), page 186, but these elements are not used alone in the industrial production and are used in combination with precipitates, with a view to attaining an auxiliary effect.

Characteristic inhibitors are disclosed by H. Grenoble in U.S. Pat. No. 3,905,842 (1975) and by H. Fiedler in U.S. Pat. No. 3,905,843 (1975). Namely, the production of a grain oriented electrical steel sheet having a high flux density is made possible by the presence of an appropriate amount of solid-dissolved S, B and N.

The standard for selection of a precipitate effective for the secondary recrystallization has not been completely clarified, but a typical opinion is stated by Matsuoka in, Iron and Steel, 53 (1967), pages 1007–1023. This opinion is summarized below.

(1) The size should be about 0.1 μm.

(2) The necessary volume is at least 0.1% by volume.

(3) The precipitate should not be completely dissolved or should not be completely insoluble in the secondary recrystallization temperature but should be solid-soluble to an appropriate extent.

The above-mentioned various precipitates satisfy some but not all of these requirements. In the process of the present invention, where the steel plate is nitrided after the cold-rolling step, the requirement (1) is of no significance.

As pointed out hereinbefore, a guidance principle for selection of a precipitate has not been established, and a search for a new technique for controlling an inhibitor has been made by trial and error.

To obtain a high flux density [high integration degree of orientation {110}<001>], a large quantity of a fine and uniform precipitate must be present in a steel plate before finish annealing, and the properties before the secondary recrystallization must be adjusted by not only control of the precipitate but also an appropriate combination of the rolling and heat treatment in compliance with the characteristics of the precipitate.

Three typical processes are now adopted for the industrial production of unidirectional electromagnetic steels, and each has merits and demerits.

The first process is a two stage cold rolling process using MnS as the inhibitor, which is proposed by M. F. Littmann in Japanese Examined Patent Publication No. 30-3651. According to this process, secondary recrystallized grains are stably grown, but a product having a high flux density cannot be obtained.

The second process is a one stage cold rolling process in which (AlN+MnS) is used as the inhibitor and final cold rolling is carried out under a high reduction ratio exceeding 80%, as proposed by Taguchi and Sakakura in Japanese Examined Patent Publication No. 40-15644. According to this process, a product having a very high flux density can be obtained, but in industrial production, the preparation conditions must be strictly controlled.

The third process is a two stage cold rolling process in which [MnS (and/or MnSe)+Sb] is used as the inhibitor, as proposed by Imanaka et al in Japanese Examined Patent Publication No. 51-13461. According to this process, a relatively high flux density can be obtained, but since poisonous and expensive elements such as Sb and Se are used, and cold rolling is conducted twice, the manufacturing cost is high.

These three processes have the following problem in common. Namely, in each of these processes, to form a fine and uniform precipitate, the precipitate must be once solid-dissolved, and therefore, the slab-heating temperature must be high.

Note, in the first process the slab-heating temperature is higher than 1260° C., and in the second process, as disclosed in Japanese Unexamined Patent Publication No. 48-51852, the slab-heating temperature differs according to the Si content in the material: where the Si content is 3%, the slab-heating temperature is 1350° C. In the third process, as taught Unexamined Patent Publication No. 51-20716, the slab-heating temperature is higher than 1230° C., and in the example where a high flux density is obtained, the slab-heating temperature is as high as 1320° C.

Namely, a slab is heated at a high temperature to solid-dissolve the precipitate and is precipitated again during the subsequent hot-rolling or heat-treating step.

Since the slab-heating temperature is high, the consumption of energy for heating is increased and the yield is reduced by slag formation. Moreover, problems arise such as an increase of the cost of repairing a heating furnace and reduction of the operation rate of the equipment. Furthermore, as taught in Japanese Examined Patent Publication No. 57-41526, a linear secondary recrystallization-insufficient portion is formed if the slab-heating temperature is high, and therefore, a continuously cast slab cannot be used.

In addition to the above-mentioned cost problem, there is another serious problem. Namely, if an iron loss-reducing means such as an increase of the Si content or reduction of the thickness of the product is adopted, the above-mentioned linear secondary recrystallization-insufficient portion is conspicuously formed and future improvement of the iron loss characteristics cannot be gained in the process in which a slab must be heated at a high temperature.

As a means for solving such problems, Japanese Examined Patent Publication No. 61-60896 proposes a process in which the secondary recrystallization is greatly stabilized by reducing the S content in steel, and an increase of the Si content and a reduction of the thickness become possible.

Furthermore, there can be mentioned a process proposed by H. Grenoble in U.S. Pat. No. 3,905,842 and a process proposed by H. Fiedler in U.S. Pat. No. 3,905,843. These processes, however, include substantial contradictions and are not industrially worked. Namely, according to this technique, since the inhibitor is composed mainly of solid-dissolved S, to maintain solid-dissolved S, the Mn content must be reduced so as not to form MnS. More specifically, a requirement of $Mn/S \leqq 2.1$ must be satisfied. But, as is well-known, solid-dissolved S has a bad influence on the toughness of the material, and accordingly, in the unidirectional electromagnetic steel plate which has a high Si content and is easily cracked, it is very difficult in industrial production to cold-roll a material containing such solid-dissolved S.

As pointed out hereinbefore, to make it possible to produce a thin product having a high flux density and a high Si content, in which a reduction of the iron loss will be possible in the future, a reconstruction of the inhibitor design is necessary.

SUMMARY OF THE INVENTION

A primary object of the present invention is to obtain a high flux density by making a large quantity of a fine and uniform precipitate present in a steel sheet before the initiation of secondary recrystallization and to prepare a grain oriented electrical steel sheet having a high flux density by adjusting the properties before secondary recrystallization in compliance with the formed precipitate.

Another object of the present invention is to provide a process for preparing a product having a high flux density by performing the slab heating at a low temperature such as adopted for an ordinary steel while reducing the occurrence of rolling cracking.

The present inventors carried out research into ways of overcoming the defects of the conventional techniques and attaining the foregoing objects, and as a result, found that an electrical steel sheet having a high flux density can be obtained stably over a broad range of the reduction ratio at the cold rolling step by controlling the amount of S and/or Se in molten steel below a certain level, cold-rolling once or at least twice a material having appropriate amounts of Al, N and Ti incorporated therein under conditions such that the amount of solid-dissolved S or Se is reduced, to form a steel sheet having a final thickness, performing decarburization annealing, coating the steel with an annealing separator, conducting finish annealing, and performing a nitriding treatment of the steel sheet during the period of from the point of completion of final cold rolling to the point of secondary recrystallization at the finish annealing step.

More specifically, in accordance with the present invention, there is provided a process for the preparation of a grain oriented electrical steel sheet having a high flux density, which comprises hot-rolling a slab comprising 1.5 to 4.8% by weight of Si, 0.012 to 0.050% by weight of Al, 0.0010 to 0.0120% by weight of N, 0.0020 to 0.0150% by weight of Ti, up to 0.45% by weight of Mn and up to 0.012% by weight of at least one member selected S and Se, which satisfies the requirement 0.06 to 0.6 of Ti/N (at % ratio) and Mn/(S+Se)>4.0 (weight ratio), performing cold rolling once or at least twice to obtain a final thickness, performing decarburization annealing in a wet hydrogen or wet hydrogen/nitrogen mixed atmosphere, coating an anneal-separator on the steel sheet surface, performing finish annealing for a secondary recrystallization and purification of the steel, and performing a nitriding treatment of the steel sheet during the period of from the point of termination of final cold rolling to the point of initiation of secondary recrystallization at the finish annealing step. Furthermore, the above-mentioned slab is heated at a temperature lower than 1200° C., before the hot rolling step.

DESCRIPTION OF THE PREFERRED EMBODIMENTS

Figure 1:
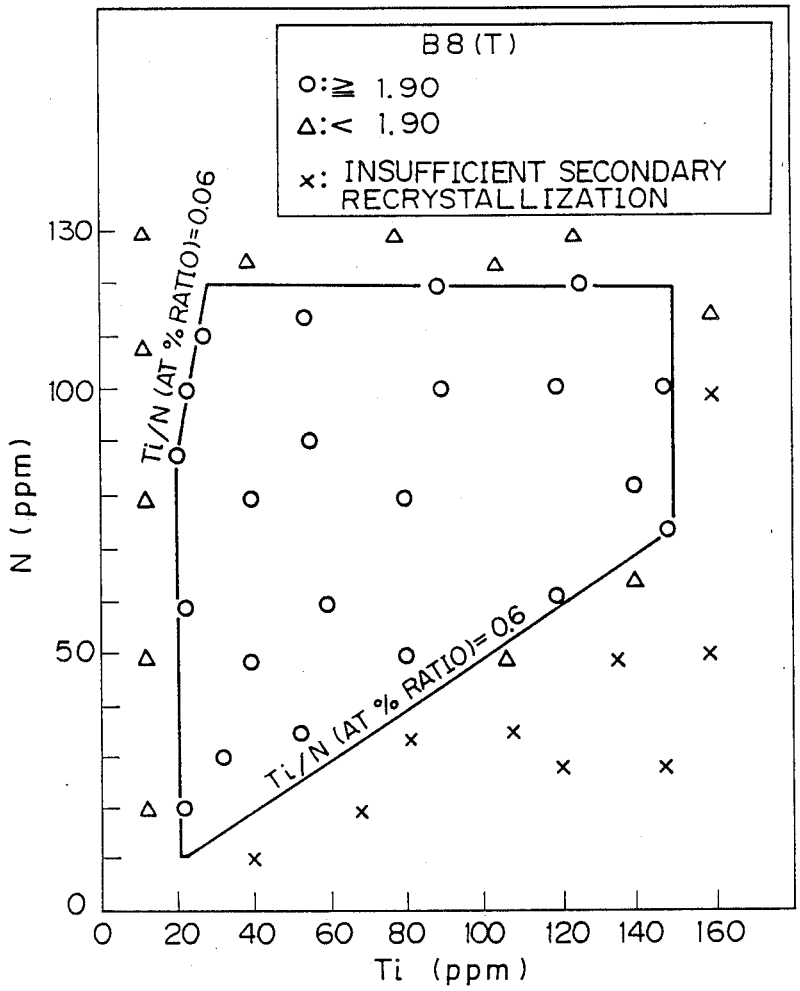
FIG. 1 is a diagram illustrating the relationship between the amounts added of N and Ti and the flux density of the product, in one example of the present invention.

The structural requirements characterizing the present invention will now be described as follows.

If the S and Se content in the steel is excessively high, a linear secondary recrystallization-insufficient portion is conspicuously formed in the length direction of the product (strip), and a stable production is impossible. This tendency is especially prominent when the Si content exceeds 3.2% (% by weight of content as follows) or in the case of a thin product having a thickness smaller than 0.23 mm (9 mil). To completely prevent a formation of a insufficient linear secondary recrystallization portion, the upper limit of the content of (S+Se) is set at 0.012%. But even if this requirement is satisfied, in the process of the present invention, the flux density is reduced by the S or Se content heretofore considered effective for increasing the flux density. Note, a lower S or Se content gives a product having a better flux density. Nevertheless, the lower limit of the content of at least one member selected from S and Se, that can be attained without an excessive increase of the cost according to the present known techniques for the production of electric steel sheets, is usually 0.0003%.

The present invention is intended to completely prevent cracking of the material during the hot rolling and cold rolling steps, to decrease the manufacturing cost, and to prevent cracking of the material which is due to solid-dissolved S or Se, and thus the requirement Mn/S+Se>4 is set to fix minute amounts of S and Se as MnS and MnSe as much as possible.

The effect attained by an addition of Ti will now be described as follows.

The hot rolled steel sheets having a thickness of 2.0 mm are prepared by heating at 1150° C. and hot rolling a 50 kg ingot comprising 0.048% of C, 3.3% of Si, 0.14% of Mn, 0.009% of S, 0.030% of P, 0.12% of Cr, 0.028% of acid-soluble Al, 10–130 ppm of N and 12–160 ppm of Ti, with the balance comprising Fe and unavoidable impurities.

The hot rolled steel sheet is annealed at 1120° C. for 2.5 minutes and at 900° C. for 2 minutes, and then pickled and cold-rolled to a final thickness of 0.20 mm. Then, decarburization annealing is carried out at 830° to 850° C. for 90 seconds in a wet hydrogen and nitrogen atmosphere, and an anneal-separator composed of a mixture of MgO, $TiO_2$, and MnN is coated on the steel sheet and finish annealing is carried out at 1200° C. for 20 hours.

FIG. 1 is a diagram illustrating the relationship between the amounts added of N and Ti when melting steel and the flux density of the product. At the amounts of 20 to 150 ppm of Ti, 10 to 120 ppm of N and 0.06–0.6 ppm of Ti/N (at % ratio), a product having a high flux density, i.e., a value $B_8$ of at least 1.90 T, can be obtained. Therefore, in the present embodiment, the amounts of Ti, N, and Ti/N are limited as mentioned above.

In the present invention, a mean of the addition N corresponds to the nitriding mean, as follows.

Al couples with N to form AlN. In the present invention, the steel must be nitrided at a later step to form an Al-containing compound. Accordingly, the presence of free Al in an amount exceeding a required level is necessary, and thus the Al content must be 0.012 to 0.050%.

The limitations of other compounds will now be described.

Preferably, the C content is 0.025 to 0.075%. If the C content is lower than 0.025%, secondary recrystallization becomes unstable at the finish annealing step, and even if a secondary recrystallization occurs, the flux density of the product is low, and if the C content is higher than 0.075%, the decarburization annealing time is long and the productivity is decreased.

Figure 2:
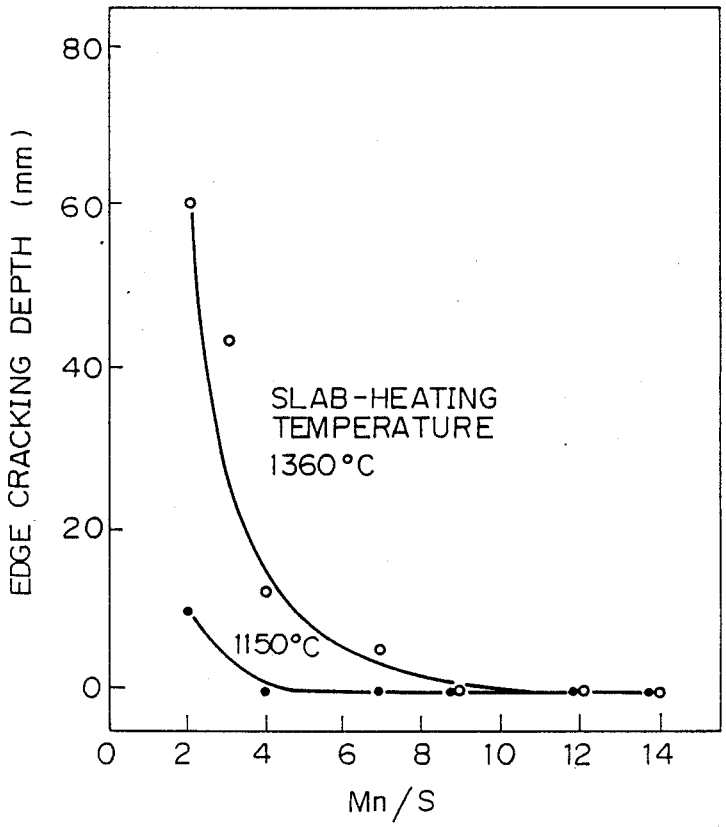
FIG. 2 is a diagram illustrating the relationship between the Mn/S and the edge cracking depth of the hot-rolled sheet in the same example.

The Mn content is determined relative to the content of S, where Mn/S>4, cracking is drastically reduced, and especially in the case of a low heating slab in which the heating temperature is 1150° C. and a solid dissolution of MnS does not occur, little cracking is caused. The relationship between the Mn/S and the end cracking depth is illustrated in FIG. 2. To prevent slivering in the hot-rolled sheet, only the requirement of Mn/S>4 need be satisfied. Nevertheless, preferably the upper limit of the Mn content is 0.45%.

If the slab-heating temperature is either a high temperature causing solid dissolution of the inhibitor, as adopted in the conventional techniques, or a low temperature adopted for an ordinary steel, considered unadaptable in the conventional techniques, secondary recrystallization still occurs, but the slab-heating temperature is preferably lower than 1200° C. because this reduces cracking of side edge portions of the hot-rolled sheet, as shown in FIG. 2, the generation of slag is controlled, and the quantity of consumption of heat for heating the slab is reduced.

For the steps after the hot-rolling, preferably the hot-rolled material is annealed for a short time to obtain a product having a highest flux density and rolled by a high roll reduction of more than 80% to the final sheet thickness. If some reduction of the magnetic characteristics is tolerable, the annealing of the hot-rolled sheets can be omitted, to reduce costs. To reduce the grain size of the final product, cold rolling can be conducted at least twice, with intermediate annealing.

After the final cold rolling, the material is subjected to decarburization annealing in an atmosphere of wet hydrogen or a mixture of wet hydrogen and nitrogen. The decarburization annealing temperature is not particularly critical, but preferably is 800° to 900° C. The dew point of the atmosphere preferably is adjusted to a level higher than +30° C.

Then an anneal-separator is coated on the material, and finish annealing is carried out at a high temperature (generally, 1100° to 1200° C.) for a long time. According to one most preferred embodiment of nitriding the steel according to the present invention, the steel is nitrided during the elevation of the temperature for the alone finish annealing, and by this nitriding, an inhibitor necessary for the secondary recrystallization is formed in the steel. To realize this nitriding, an appropriate amount of a compound having a nitriding capacity, such as MnN or CrN, is added to the annealing separator, or a gas having a nitriding capacity, such as $NH_3$, is incorporated into the atmosphere gas.

In the process of the present invention, since the slab-heating temperature is low and below 1200° C., AlN and MnS precipitated in the coarse form at the casting step are not again solid-dissolved. Accordingly, an inhibitor for controlling the growth of grains formed by a primary recrystallization, which is obtained in the conventional processes, is not obtained, and therefore, according to the present invention, by nitriding the steel sheet after the completion of cold rolling, AlN and (Al, Si)N are formed and act as the inhibitor.

Figure 3A:
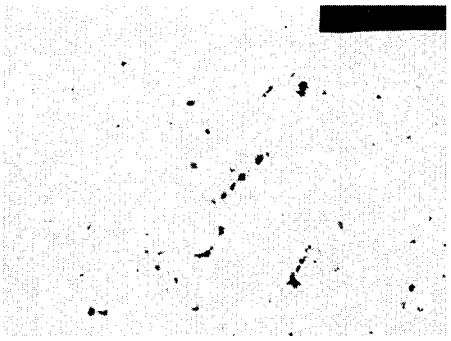
FIGS. 3-(*a*) and 3-(*b*) are photographs illustrating the inhibit-generating states in the steel sheet not subjected to the nitriding treatment and in the steel sheet subjected to the nitriding treatment, respectively.
Figure 3B:
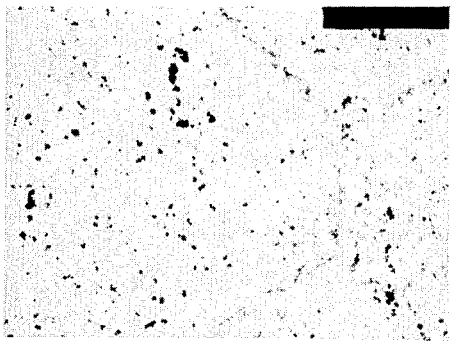

FIG. 3 illustrates that the static of formation of the inhibitor is observed with respect to a steel sheet (a) which has been subjected to decarburization annealing and a steel sheet (b) which is coated with an anneal-separator having MnN incorporated therein after decarburization annealing and heated at 1000° .C during the elevation of the temperature for finish annealing (at the initial stage of finish annealing, the steel sheet is nitrided by MnN). It is seen that, in the steel sheet (b), the inhibitor is drastically increased.

According to another embodiment of the present invention, after the soaking step in the decarburization annealing process, the steel sheet (strip) is nitrided in a gas atmosphere containing a gas having a nitriding capacity, or after the decarburization annealing, the steel sheet is nitrided in a heat-treating furnace having a gas atmosphere containing a gas having a nitriding capacity, such as $NH_3$. These processes can be adopted in combination.

The steel sheet in which the secondary recrystallization has been completed is subjected to purification annealing in a hydrogen atmosphere.

The present invention will now be described in detail with reference to the following examples, that by no means limit the scope of the invention.

EXAMPLE 1

An ingot comprising 0.048% of C, 3.3% of Si, 0.15% of Mn, 0.030% of P, 0.007% of S, 0.10% of Cr, 0.028% of Al, 0.0080% of N, and 10 ppm (a), 25 ppm (b), 50 ppm (c) or 80 ppm (d) of Ti was heated at 1200° C. and hot-rolled to obtain a hot-rolled sheet having a thickness of 2.0 mm. Then the hot rolled sheet was annealed at 1100° C. for 2 minutes and cold-rolled once to a thickness of 0.20 mm. Decarburization annealing was carried out in a wet hydrogen/nitrogen mixed atmosphere having a dew point of +60° C.

An annealing separator of MgO containing 3% by weight of $TiO_2$ and 5% by weight of ferro-manganese nitride was coated on the sheet surface, finish annealing was carried out by elevating the temperature to 1200° C. at a rate of 10° C./hr, and the sheet was maintained at this temperature for 20 hours.

An atmosphere comprising 25% of $N_2$ and 75% of $H_2$ was used during the elevation of the temperature to 1200° C. and an atmosphere comprising 100% of $H_2$ was used while the steel sheet was maintained at 1200° C.

The flux densities of the obtained products were as shown below.

| Amount (ppm) of Added Ti | $B_8$ (T) |
|---|---|
| 10 | 1.89 |
| 25 | 1.92 |
| 60 | 1.94 |
| 80 | 1.94 |

EXAMPLE 2

A silicon steel slab comprising 0.050% of C, 3.25% of Si, 0.12% of Mn, 0.0025% of P, 0.12% of Cr, 0.027% of Al, 0.0075% of N, 0.0060% of Ti, and 0.003% (a), 0.008% (b) or 0.018% (c) of S was heated at 1150° C. and hot-rolled to obtain a hot-rolled sheet having a thickness of 1.8 mm. Then the hot-rolled sheet was annealed at 1100° C. for 2 minutes and cold rolled once to a thickness of 0.18 mm. Decarburization annealing was carried out in a wet hydrogen/nitrogen mixed atmosphere having a dew point of +55° C.

An annealing separator of MgO containing 5% by weight of $TiO_2$ and 5% by weight of ferro-manganese nitride was coated on the sheet surfaces, finish annealing was carried out by elevating the temperature to 1200° C. at a rate of 15° C./hr, and the sheet was maintained at this temperature for 20 hours.

The gas atmosphere at this time was the same as in Example 1.

The magnetic characteristics of the products were as shown below.

| Amount (%) of Added S | $B_8$ (T) |
|---|---|
| 0.003 | 1.94 |
| 0.008 | 1.94 |
| 0.018 | 1.88 |

EXAMPLE 3

A slab comprising 0.048% of C, 3.4% of Si, 0.13% of Mn, 0.003% of P, 0.030% of Al, 0.0080% of N, 0.0100% of Se, 0.0080% of Ti was heated at 1200° C. and hot-rolled to obtain a hot-rolled sheet having a thickness of 2.0 mm. Then the hot-rolled sheet was annealed at 1150° C. for 2 minutes and at 900° C. for 2 minutes and rapid-cooled and pickled, and then cold-rolled once to a thickness of 0.20 mm.

Then the steel sheet was decarburization annealed at 830° C. for 90 seconds, and coated with an annealing separator of MgO containing 5% by weight of ferro-manganese nitride, heated to 1200° C. at a temperature elevating rate of 10° C./hr, and annealed at 1200° C. for 20 hours. A mixed gas comprising 50% of $N_2$ and 50% of $H_2$ was used as the atmosphere during the elevation of the temperature to 1200° C. and a gas comprising 100% of $H_2$ was used as the atmosphere at the soaking step, at 1200° C.

The magnetic characteristic of the product was as shown below.

Flux density $B_8$ (T): 1.94

EXAMPLE 4

A slab comprising 0.043% of C, 3.2% of Si, 0.14% of Mn, 0.009% of S, 0.030% of P, 0.027% of Al, 0.0070% of N, and 0.0010% (a) or 0.0090% (b) of Ti was heated at 1150° C. and hot-rolled to obtain a hot-rolled sheet having a thickness of 2.3 mm.

The hot-rolled sheet was pickled and cold-rolled once to a thickness of 0.30 mm, then decarburization annealing was carried out at 830° C. for 150 seconds, the steel sheet was coated with an annealing separator of MgO containing $TiO_2$ and CrN, was heated to 1200° C. at a temperature elevating rate of 15° C./hr, and maintained at 1200° C. for 20 hours to effect finishing annealing. A mixed gas comprising 50% of $N_2$ and 50% of $H_2$ was used as the atmosphere during the elevation of the temperature, and a gas comprising 100% of $H_2$ was used as the atmosphere while the sheet was maintained at 1200° C.

The magnetic characteristics of the products were as shown below.

| Slab | $B_8$ (T) |
|---|---|
| (a) | 1.85 |
| (b) | 1.89 |

As apparent from the above results, if the Ti content was included, a product having a high flux density was obtained.

EXAMPLE 5

A slab comprising 0.050% of C, 3.5% of Si, 0.14% of Mn, 0.007% of S, 0.030% of P, 0.031% of Al, 0.0075% of N and 0.0065% of Ti was heated at 1150° C. and hot-rolled to obtain a hot-rolled sheet having a thickness of 2.5 or 1.6 mm. A hot-rolled sheet having a thickness of 2.5 mm was pickled and cold-rolled once to a thickness of 1.6 mm. The hot-rolled sheet and the cold-rolled sheet of 1.6 mm were simultaneously annealed at 1120° C. for 2.5 minutes and then rapid-cooled.

The above sheets were cold-rolled to obtain a thickness of 0.150 mm, then decarburization annealing was carried out at 830° C. for 70 seconds, the sheets were coated with an annealing separator of MgO containing $TiO_2$ and MnN, and were maintained at 1200° C. for 20 hours to effect finish annealing. A mixed gas comprising 25% of $N_2$ and 75% of $H_2$ was used as the atmosphere during the elevation of the temperature, and a gas comprising 100% of $H_2$ was used as the atmosphere while the sheets were maintained at 1200° C.

The magnetic characteristics of the products were as shown below.

| | Two Stage Rolling Method (hot-rolled sheet thickness = 2.5 mm) | One Stage Rolling Method (hot-rolled sheet thickness = 1.6 mm) |
|---|---|---|
| $B_8$ (T) | 1.91 | 1.92 |
| Crystal Grain Size (ASTM No. × 1) | 4 | 2 |

EXAMPLE 6

A slab comprising 0.053% of C, 3.35% of Si, 0.14% of Mn, 0.006% of S, 0.030% of P, 0.032% of Al, 0.0073% of N, and 0.0060% of Ti was heated at 1150° C. and hot-rolled to obtain a hot-rolled sheet having a thickness of 1.8 mm, and annealed at 1120° C. for 2 minutes, then cold-rolled once to a final thickness of 0.20 mm, and decarburization annealing was carried out at 850° C. for 70 seconds. Then the sheet was heated at 650° C. for 3 minutes in a nitrogen gas containing 5% of $NH_3$ and coated with an annealing separator of MgO, and finish annealing was carried out by heating the sheet to 1200° C. at a rate of 10° C./hr and maintaining it at 1200° C. for 20 hours.

The magnetic characteristic of the obtained product is as shown below, and a high flux density was obtained.

Flux Density $B_8$(T): 1.94

As apparent from the foregoing description, according to the present invention, even when the low-temperature slab heating customarily adopted for ordinary steel sheets was used, unidirectional electromagnetic steel sheets having a high flux density were obtained with a considerable reduction in the rolling cracking, and thus the present invention is very valuable from the industrial viewpoint.

We claim:

1. A process for the preparation of a grain oriented silicon steel sheet having a high flux density, which comprises heating a slab at a slab heating temperature of lower than 1200? C., said slab comprising 1.5 to 4.8% by weight of Si, 0.012 to 0.050% by weight of Al, 0.0010 to 0.0120% by weight of N, 0.002 to 0.0150% by weight of Ti, up ro 0.45% by weight of Mn and up to 0.012% by weight of at lest one member selected from S and Se, which satisfies the requirement of 0.06 to 0.6 of Ti/N (at % ratio) and $Mn/(S+Se) \geqq 4.0$ (weight ratio), with the balance comprising Fe and unavoidable impurities, not-rolling the slab, performing cold rolling once or at least twice to obtain a final thickness, performing decarburization annealing in a wet hydrogen or wet hydrogen/nitrogen mixed atmosphere, coating an annealing separator on the st®el sheet surface, performing finish annealing for secondary recrystallization and purification of the steel sheet, and performing a nitriding treatment of the steel sheet during the period of from the point of termination of final cold rolling to the point of initiation of secondary recrystallization at the finish annealing step.

2. A process according to claim 1, wherein the nitriding treatment is carried out during the temperature elevation period at the final annealing step.

3. A process according to claim 2, wherein the compound having a nitriding capacity is incorporated i the annealing separator.

4. A process according to claim 2, wherein a gas having a nitriding capacity is incorporated in an atmosphere gas at the final annealing step.

5. A process according to claim 1, wherein the nitriding treatment is performed in an atmosphere of a gas having a nitriding capacity after soaking at the decarburization annealing step.

6. A process according to claim 1 wherein after decarburization annealing, the nitriding treatment is performed by positioning a heat treating furnace after a decarburization annealing furnace, and providing said heat treating furnace with a nitriding gaseous atmosphere.

* * * * *

UNITED STATES PATENT AND TRADEMARK OFFICE

CERTIFICATE OF CORRECTION

PATENT NO. : 4,938,807

DATED : July 3, 1990

INVENTOR(S) : N. Takahashi, et al.

It is certified that error appears in the above-identified patent and that said Letters Patent is hereby corrected as shown below:

Column 2, line 15, change "organical" to --organic--.

Column 3, line 42, between "taught" and "Unexamined" insert --in Japanese--.

Column 5, lines 3 and 60 change ">" to --≥--.

Column 5, line 43, change "a" to --an--.

Column 6, lines 38 and 44, change ">" to --≥--.

Column 10, line 31, change "1200?" to --1200°--.

Column 10, line 34, change "ro" to --to--.

Column 10, line 35, change "lest" to --least--.

Column 10, line 38, change "not-" to --hot---.

UNITED STATES PATENT AND TRADEMARK OFFICE

CERTIFICATE OF CORRECTION

PATENT NO. : 4,938,807

DATED : July 3, 1990

INVENTOR(S) : N. Takahashi, et al.

It is certified that error appears in the above-identified patent and that said Letters Patent is hereby corrected as shown below:

Column 10, line 43, change "st®el" to --steel--.

Column 10, line 53, change "incorporated i" to --incorporated in--.

Signed and Sealed this

Tenth Day of December, 1991

*Attest:*

HARRY F. MANBECK, JR.

*Attesting Officer*

*Commissioner of Patents and Trademarks*